US005505168A

United States Patent [19]

Nagai et al.

[11] Patent Number: 5,505,168

[45] Date of Patent: Apr. 9, 1996

[54] VARIABLE LIFT HEIGHT VALVE DRIVING DEVICE

[75] Inventors: Susumu Nagai; Nobuo Iida, both of Amagasaki, Japan

[73] Assignee: Osaka Fuji Kogyo Kabushiki Kaisha, Japan

[21] Appl. No.: 323,911

[22] Filed: Oct. 17, 1994

[30] Foreign Application Priority Data

Feb. 25, 1994 [JP] Japan ..... 6-028394

[51] Int. Cl.[6] ..... F01L 13/00

[52] U.S. Cl. ..... 123/90.17; 123/90.6; 74/568 R

[58] Field of Search ..... 123/90.15, 90.16, 123/90.17, 90.18, 90.6; 74/567, 568 R

[56] References Cited

U.S. PATENT DOCUMENTS 862,448 8/1907 Cornilleau ..... 123/90.17
2,888,837 6/1959 Hellman ..... 123/90.17
5,211,141 5/1993 Hannibal et al. ..... 123/90.17

FOREIGN PATENT DOCUMENTS 3705128 9/1988 Germany ..... 123/90.17
133409 8/1983 Japan ..... 123/90.17

*Primary Examiner*—Weilun Lo
*Attorney, Agent, or Firm*—Ostrolenk, Faber, Gerb & Soffen

[57] ABSTRACT

A variable lift height valve driving device which drives a valve of an internal combustion engine, varying the lift height of the valve. An inner shaft is disposed in a hollow cam shaft to be capable of reciprocating along the axis. A primary cam which has a primary cam surface is fitted around the hollow cam shaft at a specified position, and a secondary cam which has a secondary cam surface is fitted to the primary cam. With movement of the inner shaft, the secondary cam moves such that the secondary cam surface is set in a position to be on a level with the primary cam surface or in a position to protrude outward from the primary cam surface.

7 Claims, 3 Drawing Sheets

VARIABLE LIFT HEIGHT VALVE DRIVING DEVICE

BACKGROUND OF THE INVENTION

1. Field of the Invention

The present invention relates to a variable lift height valve driving device, and more particularly to a variable lift height valve driving device which drives a valve of an internal combustion engine, varying the lift height of the valve depending on the driving state.

2. Description of Related Art

In the art of automobile engine, it is generally known to vary open/close timing of a valve depending on the driving state, namely, the engine speed and the engine torque. It is also known to vary the lift height of the valve depending on the driving state in order to improve the engine output and fuel consumption more.

In such a conventional variable lift height valve driving device, each cam shaft for driving each valve has a low-speed cam and a high-speed cam, and rotating forces of the cams are transmitted to the valve via a center rocker arm and a side rocker arm respectively.

Since the conventional device requires a plurality of rocker arms, the device becomes large. Further, since a mechanism for combining/separating the center rocker arm and the side rocker arm is necessary, the structure of the device is complicated.

SUMMARY OF THE INVENTION

An object of the present invention is to provide a variable lift height valve driving device which has a simple and compact structure.

In order to attain this object, a variable lift height valve driving device according to the present invention comprises a hollow outer cam shaft, a primary cam which has a primary cam surface, a secondary cam which has a secondary cam surface and is fitted to the primary cam, an inner shaft for moving the secondary cam and driving means for moving the inner shaft. The secondary cam is movable such that the secondary cam surface is movable between a position to be on a level with the primary cam surface and a position to protrude outward from the primary cam surface. The inner shaft is disposed in the hollow outer cam shaft and can be reciprocated along the axis by the driving means. With movement of the inner shaft in one direction, the secondary cam moves such that the secondary cam surface moves to the position to be on a level with the primary cam surface, and with movement of the inner shaft in the other direction, the secondary cam moves such that the secondary cam surface moves to the position to protrude outward from the primary cam surface. The secondary cam surface is exposed. Preferably, it directly contacts the valve.

While the secondary cam surface is on a level with the primary cam surface, the valve is driven regulated by the primary cam surface, and in this state, the valve is driven to have a small lift height in accordance with the configuration of the primary cam surface. On the other hand, while the secondary cam surface protrudes from the primary cam surface, the valve is driven regulated by the secondary cam surface, and in this state, the valve is driven to have a large lift height in accordance with the configuration of the secondary cam.

Thus, according to the present invention, the valve lift height can be varied depending on the driving state by adopting a simple structure wherein an inner shaft is disposed in a hollow cam shaft to move a secondary cam fitted to a primary cam.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An exemplary variable lift height valve driving device according to the present invention is described with reference to the accompanying drawings.

Figure 1:
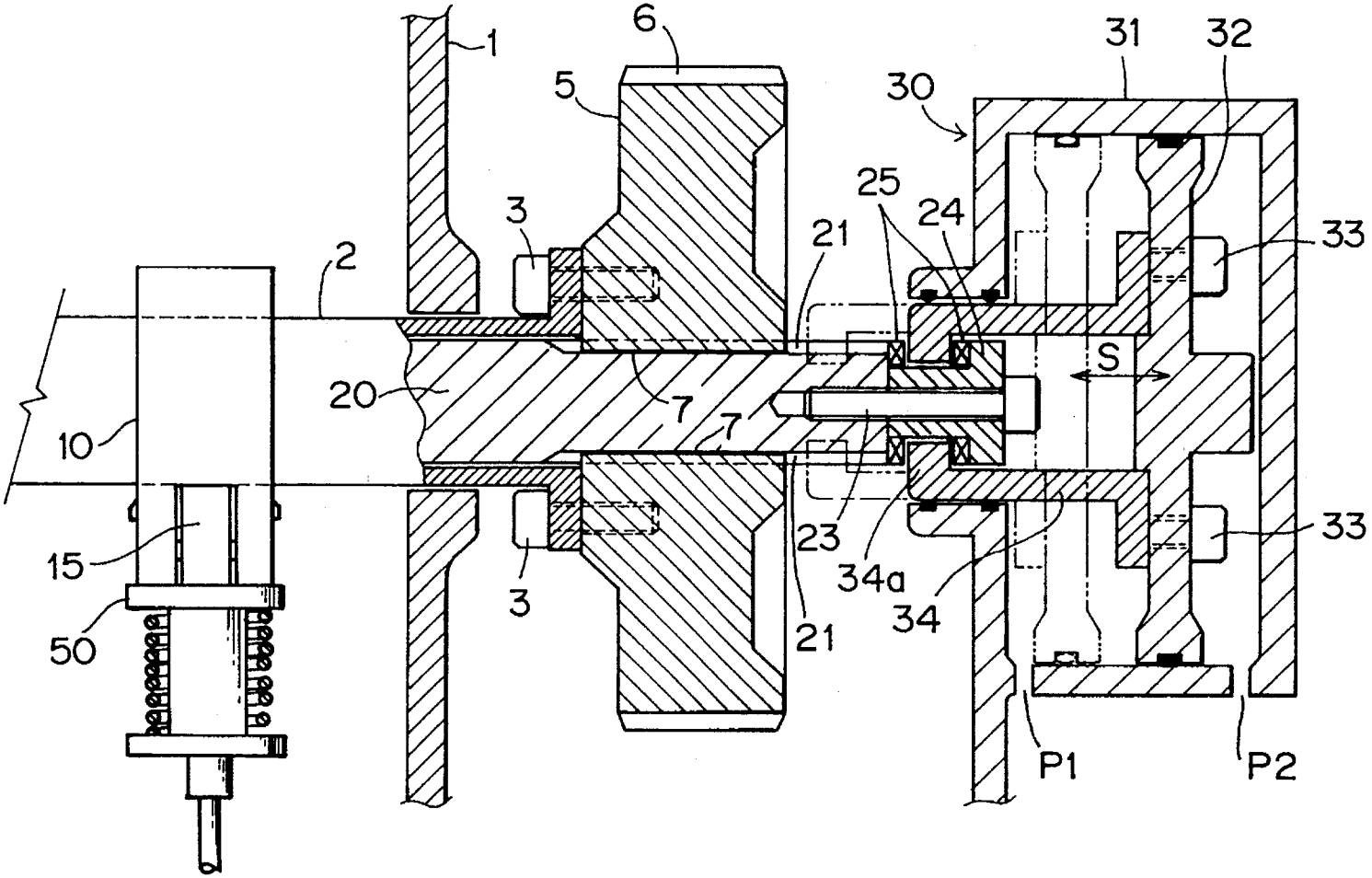
FIG. 1 is a sectional view of a variable lift height valve driving device which is an embodiment of the present invention.

In FIG. 1, numeral 1 denotes an engine casing, numeral 2 denotes a hollow outer cam shaft, numeral 5 denotes a pulley, numeral 10 denotes a primary cam, numeral 15 denotes a secondary cam, numeral 20 denotes an inner shaft 20, numeral 30 denotes a hydraulic mechanism, and numeral 50 denotes a valve for intake or exhaust.

The cam shaft 2 is integral with the pulley 5 via bolts 3. A timing belt (not shown) is laid around teeth 6 which are formed on the circumference of the pulley 5, and the timing belt is driven to rotate by a crank shaft (not shown). With the rotation of the crank shaft, the cam shaft 2 and the primary and secondary cams 10 and 15 rotate, thereby driving the valve 50. This driving mechanism is well known.

The inner shaft 20 is disposed inside the hollow cam shaft 2 so as to be movable in the axial direction. The inner shaft 20 has grooves 21 on the circumference thereof, and the pulley 5 has projections 7. The projections 7 engage with the grooves 21, and thereby, the inner shaft 20 rotates together with the pulley 5 and the cam shaft 2.

The hydraulic mechanism 30 reciprocate the inner shaft 20 along the axis by a specified distance S. A piston 32 is provided in a cylinder 31, and a drum 34 is fitted to the piston 32 by bolts 33. The inner shaft 20 is fitted to a bracket 24 by a bolts 23, and an edge portion 34*a* of the drum 34 engages with the bracket 24 via a thrust bearing 25. The cylinder 31 has ports P1 and P2. The port P1 is connected with a hydraulic oil supply section 37 via a first electromagnetic valve 35, and the port P2 is connected with a hydraulic oil exhaust section 38 via a second electromagnetic valve 36 (see FIG. 6).

Figure 6:
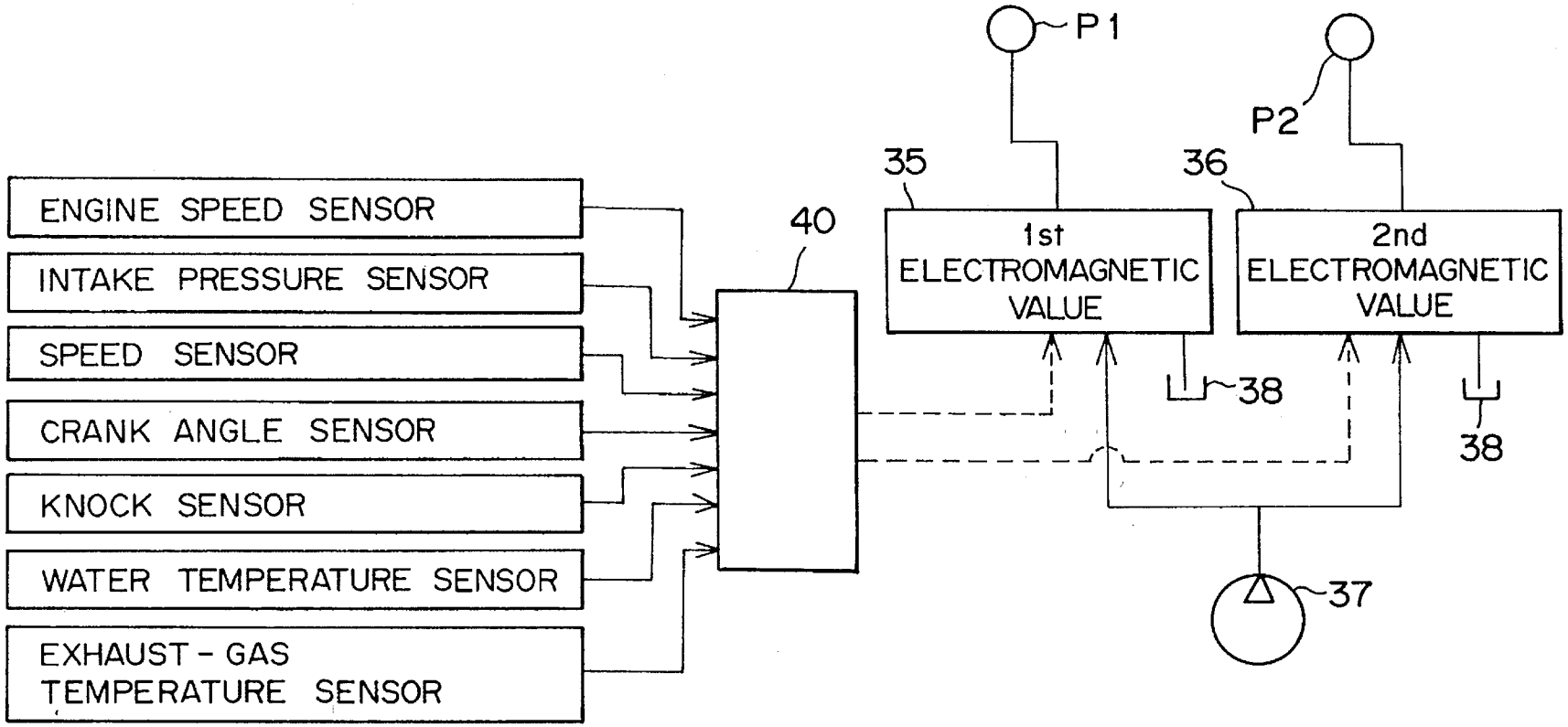
FIG. 6 is a block diagram of a control circuitry of the variable lift height valve driving device.

As shown in FIG. 6, the first and second electromagnetic valves 35 and 36 are turned on and off under control of a microcomputer 40. The microcomputer 40 receives data from various sensors for detecting the driving state, namely, an engine speed sensor, an intake pressure sensor, a speed sensor, a crank angle sensor, a knock sensor, a water temperature sensor and an exhaust-gas temperature sensor, and controls the running of the engine depending on these data.

Now referring to FIGS. 2 through 5, the primary cam 10 and the secondary cam 15 are described.

The primary cam 10 is fixed around the outer cam shaft 2 at a specified position. The primary cam 10 has a primary cam surface 10a which projects outward, and a space 11 is provided inside of the portion of the cam surface 10*a*. The secondary cam 15 has a secondary cam surface 15*a* which projects outward and a leg 16. The secondary cam 15 is fitted in the space 11 of the primary cam 10, and a pin 13 of the primary cam 10 is inserted into a long hole 17 of the secondary cam 15. As a result, the secondary cam 15 is movable in the radial direction of the primary cam 10 within a distance L in which the pin 13 can be guided by the long hole 17. A tension spring 14 is inserted in a hole 12 of the primary cam 10 and in a hole 18 of the secondary cam 15, and thereby, the secondary cam 15 is always urged inward with respect to the radial direction of the primary cam 10. The inner shaft 20 has an inclined surface 22, and the end of the leg 16 of the secondary cam 15 is made as an inclined surface 16*a* to engage with the inclined surface 22.

Figure 3:
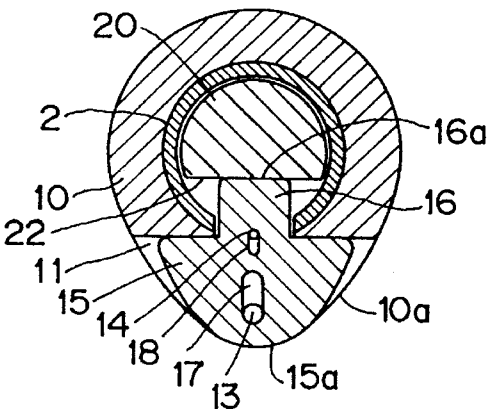
FIG. 3 is a cross sectional view of the variable lift height valve driving device which is set for a small lift height.
Figure 2:
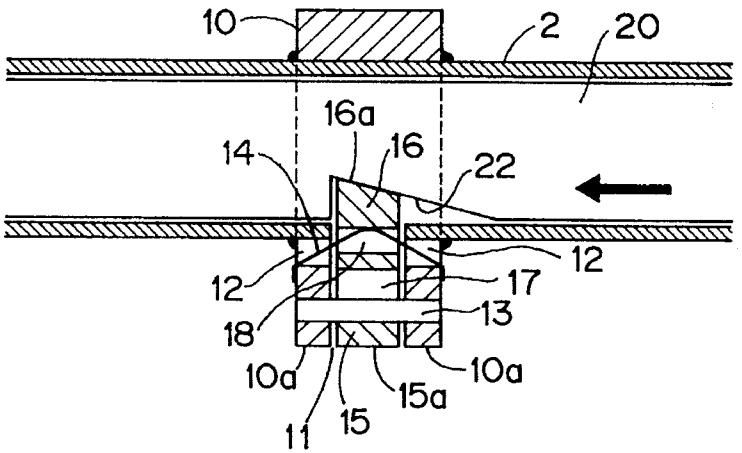
FIG. 2 is a longitudinal sectional view of the variable lift height valve driving device which is set for a small lift length.

FIGS. 2 and 3 show the cams 10 and 15 set for a smaller valve lift height (a low engine speed). The first electromagnetic valve 35 is turned on, and hydraulic oil is supplied to a left chamber of the cylinder 31 through the port P1 and is exhausted from the cylinder 31 through the port P2. Thereby, the piston 32 moves to the right in FIG. 1, and accordingly, the inner shaft 20 moves to the right. With the movement of the inner shaft 20, the leg 16 of the secondary cam 15 comes inward toward the axis of the inner shaft 20 guided by the inclined surface 22. Thus, the secondary cam 15 is set in a position wherein the secondary cam surface 15*a* and the primary cam surface 10*a* are on the same level. In this state, the valve 50 is driven, regulated by the primary cam surface 10*a*.

Figure 5:
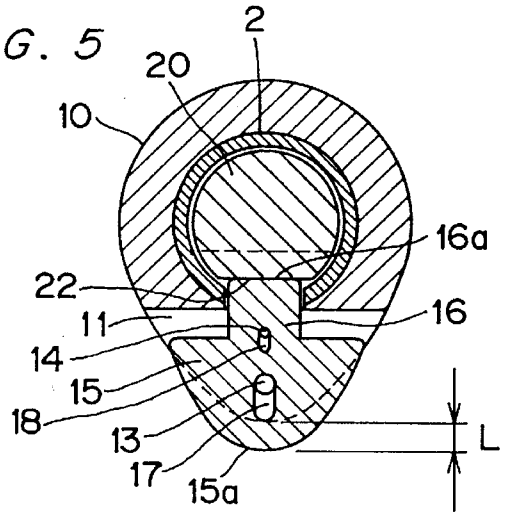
FIG. 5 is a cross sectional view of the variable lift height valve driving device which is set for a large lift height.
Figure 4:
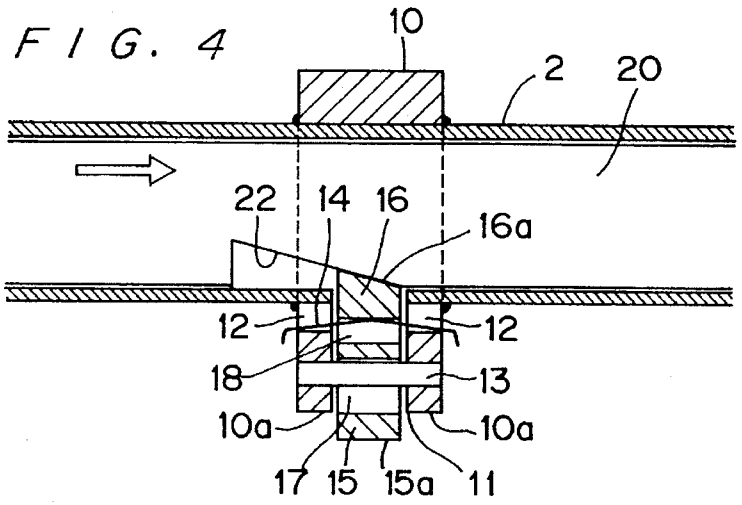
FIG. 4 is a longitudinal sectional view of the variable lift height valve driving device which is set for a large lift height.

FIGS. 4 and 5 show the cams 10 and 15 set for a large valve lift height (a high engine speed). The second electromagnetic valve 36 is turned on, and the hydraulic oil is supplied to a right chamber of the cylinder 31 through the port P2 and is exhausted from the cylinder 31 through the port P1. Thereby, the piston 32 moves to the left in FIG. 1, and accordingly, the inner shaft 20 moves to the left. With the movement of the inner shaft 20, the leg 16 of the secondary cam 15 is pushed outward guided by the inclined surface 22. Thus, the secondary cam 15*a* is set in a position wherein the secondary cam surface 15*a* protrudes from the primary cam surface 10*a* by the distance L. In this state, the valve 50 is driven regulated by the secondary cam surface 15*a*.

The hydraulic mechanism 30 and the electromagnetic valves 35 and 36 can be made to have any other structure. The primary cam 10, the secondary cam 15 and the inclined surface 22 of the inner shaft 20 can have other configurations.

Although the present invention has been described in connection with the preferred embodiment, it is to be noted that various changes and modifications are possible to those who are skilled in the art. Such changes and modifications are to be understood as being within the scope of the present invention.

What is claimed is:

1. A variable lift height valve driving device which drives a valve of an internal combustion engine at a variable valve lift height, the variable lift height valve driving device comprising:

a hollow outer cam shaft;

a primary cam fitted around the outer cam shaft, the primary cam having a primary cam surface which projects outward;

a secondary cam which has a secondary cam surface, the secondary cam being movably fitted to the primary cam such that the secondary cam surface is movable between a first position to be on a level with the primary cam surface and a second position to protrude outward from the primary cam surface;

an inner shaft for moving the secondary cam, the inner shaft being disposed in the hollow outer cam shaft to be capable of reciprocating along its axis, movement of the inner shaft in one direction moving the secondary cam into the first position and movement of the inner shaft in the other direction moving the secondary cam into the second position; and driving means for moving the inner shaft.

2. A variable lift height valve driving device as claimed in claim 1, wherein the driving means uses oil as a drive source of the inner shaft.

3. A variable lift height valve driving device as claimed in claim 1, wherein:

the inner shaft has an inclined surface on its circumference; and the secondary cam has an inclined surface engaging with the inclined surface of the inner shaft.

4. A variable lift height valve driving device as claimed in claim 1, wherein said primary and secondary cam surfaces are exposed to act as driving surfaces to drive the valve.

5. A variable lift height valve driving device as claimed in claim 4, wherein the secondary cam in biased into the first position by a spring which does not contact either the primary cam surface or the secondary cam surface.

6. A variable lift height valve driving device according to claim 5, wherein openings are formed in the primary and secondary cams and the spring extends between those openings.

7. A variable lift height valve driving device according to claim 6, further including a pin extending between the primary and secondary cams for limiting the degree of movement of the secondary cam relative to the primary cam.

* * * * *